US005869779A

United States Patent [19]

Kraisrisinsuk

[11] Patent Number: 5,869,779

[45] Date of Patent: Feb. 9, 1999

[54] MUSICAL BOX MOVEMENT

[75] Inventor: Kittipong Kraisrisinsuk, Kowloon, Hong Kong

[73] Assignee: Mitsuyo Seiki (H.K.) Company Limited, Hong Kong, Hong Kong

[21] Appl. No.: 815,316

[22] Filed: Mar. 10, 1997

[51] Int. Cl.[6] ..... G10F 1/06

[52] U.S. Cl. ..... 84/94.1; 84/95.1

[58] Field of Search ..... 84/94.1, 94.2, 84/95.1, 95.2, 96, 98

[56] References Cited

U.S. PATENT DOCUMENTS 5,459,278 10/1995 Hsu ..... 84/95.1

*Primary Examiner*—William M. Shoop, Jr.
*Assistant Examiner*—Shih-yung Hsich
*Attorney, Agent, or Firm*—Samuels, Gauthier & Stevens

[57] ABSTRACT

A musical box movement includes an auxiliary winder shaft which can be positioned centrally with respect to a musical box movement. In prior art arrangements, as the normal winder shaft has inherently to be off-set with respect to a mean or central axis of the assembled musical box movement, not feasible to certain design limitations are normally experienced, which embodiments of the invention overcome.

5 Claims, 2 Drawing Sheets

MUSICAL BOX MOVEMENT

BACKGROUND OF THE INVENTION

1. Field of the Invention

The invention relates to musical box movements.

2. Description of Prior Art

Musical box movement comprise a spiked barrel that plucks resilient turned prongs as the barrel rotates to provide the specific chosen melodies. The barrel is driven by a spring and the musical box movement incorporates a rotational speed governor and usually a start/stop lever and so forth. Such musical box movements have been used and known for several decades at least, and the movements are quite often mounted in a container below a doll dancer for example that is also controlled using stored energy of the same spring. In any event, and traditionally, a spring housing is mounted adjacent one end of the barrel and the overall or outer dimensions of the spring housing and interconnected barrel determine the effective minimum size of any musical box that incorporates the movement.

The spring is wound up by rotation of a central shaft extending into the spring housing and inherently therefore the shaft is off-centre in relation to a centre of any minimum sized musical box. This leads to certain restrictions in design and some overall disadvantages.

SUMMARY OF THE INVENTION

It is an object of the invention to overcome or at least reduce these restrictions or disadvantages.

According to the invention there is provided a musical box movement having a barrel and a spring housing with a central winding shaft, and a frame having a generally central axis and supporting the barrels and spring housing at either side of the central axis, including an auxiliary winding shaft mounted to the frame with a rotational axis on the central axis, and two gear wheels on the winding shaft and on the auxiliary shaft respectively that are mechanically interconnected to one another.

Preferably, the two gear wheels are mechanically interconnected via a third gear mounted to the frame.

BRIEF DESCRIPTION OF THE DRAWINGS

A musical box movement according to the invention will now be described by way of example with reference to the accompanying drawings in which.

DESCRIPTION OF THE PREFERRED EMBODIMENTS

Figure 1:
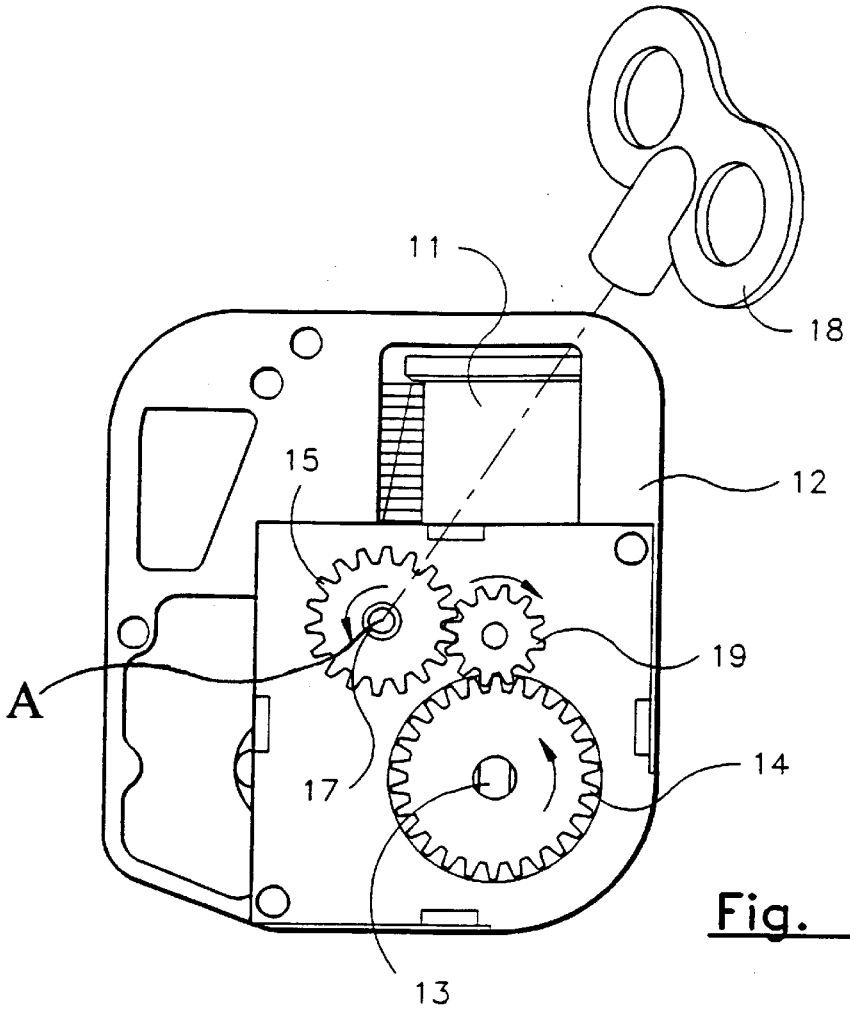
FIG. 1 is a bottom view of a musical box construction with a base plate removed.

Referring to the drawings, the conventional parts of the musical box movement are not shown in full or at all, especially the drive interconnections, the speed controller and so forth as they are well known and generally standard parts in this art. In the Figures a spring housing 10 and a barrel 11 are mounted to a frame 12. A winding shaft 13 is mounted extending into the housing 10 and a first gear 14 is keyed to one end of the shaft. A second gear 15 is mounted to the frame 12 and normally held in position by a cover plate 16. The gear 15 has a threaded shaft 17 to receive a winder key 18. A third gear 19 is mounted to the frame 12 and also held in position by the cover plate 16, and so that the gears 14 and 15 are mechanically interconnected via the third gear 19.

Figure 4:
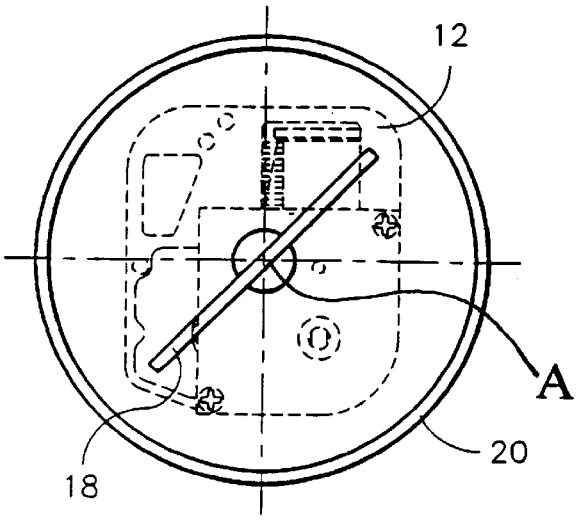
FIG. 4 is a view of a base of a toy box incorporating the movement.
Figure 5:
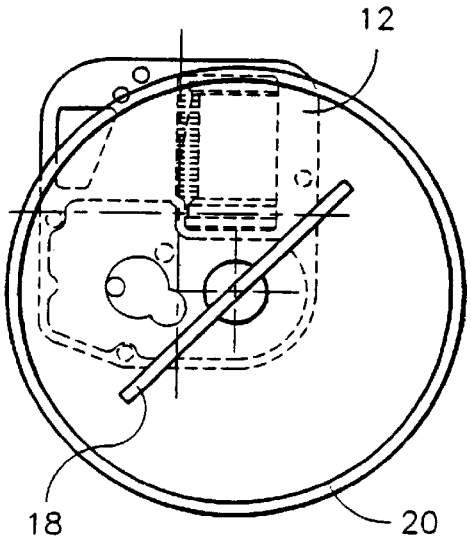
FIG. 5 is a rear view of a toy box incorporating a musical box movement of the prior art.
Figure 2:
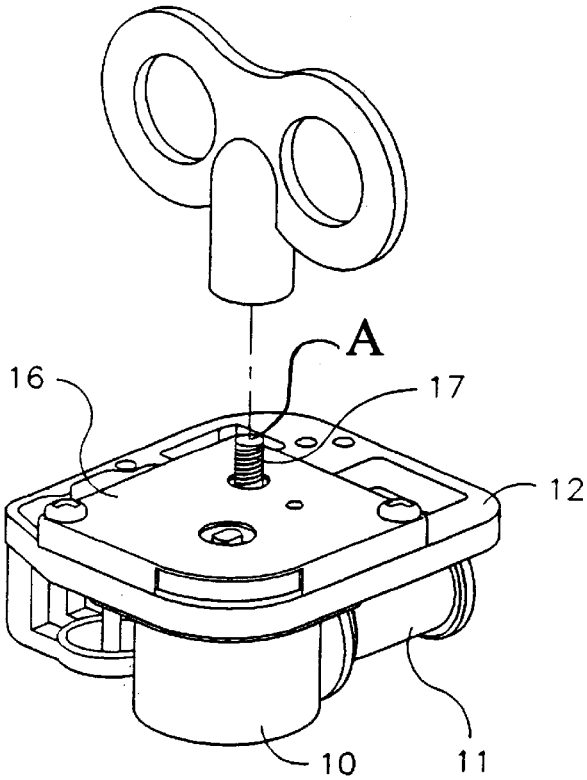
FIG. 2 is an assembled isometric bottom view of the musical box construction.
Figure 3:
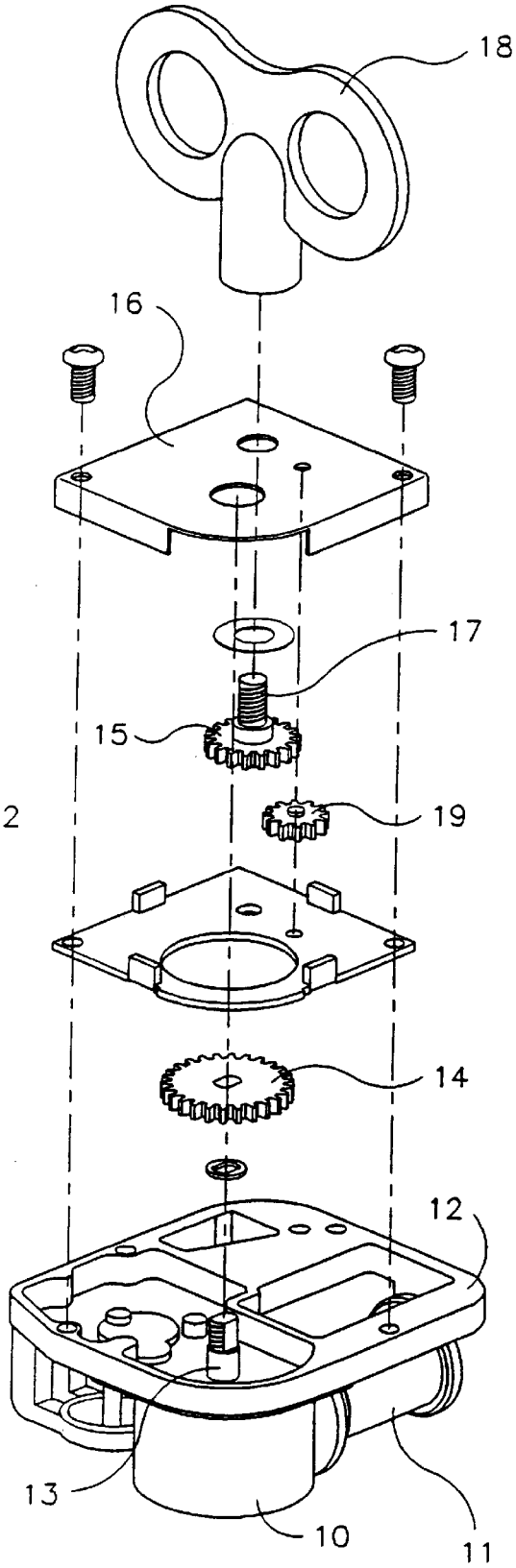
FIG. 3 is an exploded isometric bottom view of the musical box construction.

It can be seen in the Figures, especially FIG. 1, that the shaft 17 lies on or near a central axis A through the frame 12, i.e. is at the approximate center of the frame, and that the components of the musical box lie at either side of the central axis. The significant practical advantage of this arrangement is well illustrated by comparing FIGS. 4 and 5. In FIGS. 4 and 5, which both show the winding key 18 fitted, a significant design latitude is provided especially as seen by comparing the required outer dimensions of the boxes 20, usually decorative word or plastic covers in practice clearly in FIG. 5. The box of FIG. 5 must either be larger or the winder 16 centrally off-set to incorporate the same sized frame 12. Thus, the same maximum overall dimensions can be achieved in FIG. 5 by off-setting the winder, but this reduces design flexibility. On the one hand, wings of a suitable winder key must be shorter, as such wings must usually fit inside the box, that is within an inner underside periphery of the box. On the other hand, where the box sits on a suitable winder, which could be a suitable annulus support base, for rotation in use about a central axis of the winder, the box can only rotate about an axis that is off-set from its own central axis. This would lead to rather unnatural or ungraceful movement as a rule.

It will be noted that the movement includes three gears. It is possible to use only two gears but three are preferred. This is because springs are normally designed to be wound up by clockwise operation of a key, or similar. If three gears are used, the conventional winding up rotational direction is maintained and so the described musical box movement is, in practical terms, more "user-friendly". The user does not need to consider whether to turn the key clockwise or not, and a conventional right-handed thread can be provided on the shaft 17 where a threaded key is used.

It will be noted that the gear 15 is smaller than the gear 14. In fact, the gear ratio of gears 14 to 15 is about 1½ to 1, which is a preferred arrangement. However, the described musical box movement can be provided with a wide range of gear ratios introducing as an extra bonus, in terms of design choices, to match likely users and the spring rating of different applications for the movements.

We claim:

1. A musical box movement, said music box movement comprising:

a frame, said frame having a central axis therethrough at an approximate center of said frame;

a spring housing;

a barrel, wherein said spring housing and said barrel are mounted to said frame;

a threaded shaft positioned along said central axis of said frame;

a first gear mounted on a winding shaft parallel to said central axis; and a second gear mounted on said threaded shaft; said two gears being mechanically interconnected such that said music box movement is wound along said threaded shaft.

2. The musical box according to claim 1, in which the two gear wheels are mechanically interconnected via a third gear mounted to the frame.

3. The musical box according to claim 1, in which a gear ratio between the gear on the winding shaft and the gear on the auxiliary winding shaft is about 1½ to 1.

4. The music box of claim 1 which includes a winding key to wind said music box.

5. The music box of claim 4, wherein said winding key is positioned on said central threaded shaft to wind said music box.

* * * * *